United States Patent [19]

Schwaderer et al.

[11] Patent Number: 4,618,756

[45] Date of Patent: Oct. 21, 1986

[54] AIR CIRCULATION SYSTEM FOR MICROWAVE OVEN

[75] Inventors: John R. Schwaderer, Claridon Township, Marion County; Mark J. Kristof, Marion Township, Marion County, both of Ohio

[73] Assignee: Whirlpool Corporation, Benton Harbor, Mich.

[21] Appl. No.: 752,816

[22] Filed: Jul. 8, 1985

[51] Int. Cl.[4] ..... H05B 6/64

[52] U.S. Cl. ..... 219/10.55 R; 219/400; 219/10.55 E; 126/21 A

[58] Field of Search ..... 219/10.55 R, 10.55 B, 219/10.55 E, 400; 126/21 A, 21 R, 273 R, 198; 312/236

[56] References Cited

U.S. PATENT DOCUMENTS

| | | | |
|---|---|---|---|
| 2,860,026 | 11/1958 | Long | 219/10.55 B |
| 3,339,054 | 8/1967 | Deaton | 219/10.55 B |
| 3,430,023 | 2/1969 | Tingley | 219/10.55 R |
| 3,485,229 | 12/1969 | Gilliom | 219/400 |
| 3,654,417 | 4/1972 | Javes et al. | 219/10.55 R |
| 3,783,219 | 1/1974 | Tateda | 219/400 |
| 3,818,171 | 6/1974 | Miller et al. | 126/21 A |
| 3,962,561 | 6/1976 | Maitenaz | 219/391 |
| 4,049,938 | 9/1977 | Ueno | 219/10.55 B X |
| 4,107,501 | 8/1978 | Ironfield | 219/10.55 B |
| 4,123,643 | 10/1978 | Burke | 219/10.55 R |
| 4,184,945 | 1/1980 | Morgan et al. | 219/10.55 R |
| 4,221,949 | 9/1980 | Minakawa | 219/10.55 R |
| 4,314,126 | 2/1982 | Yoshimura et al. | 219/10.55 R |
| 4,327,274 | 4/1982 | White et al. | 219/10.55 R |

*Primary Examiner*—Philip H. Leung

*Attorney, Agent, or Firm*—Hill, Van Santen, Steadman & Simpson

[57] ABSTRACT

An air circulation system for a microwave oven is provided which includes air inlet openings in the front wall, bottom wall and rear wall of the oven cabinet to cause air to flow over the various electrical components within the oven cabinet prior to passing through an air blower. All the air passing through the blower passes over the magnetron for cooling purposes and then the air flow is split into three air streams, one air stream passing through the cooking cavity for removal of humidity, a second air stream passing through the cooking cavity above a protective cover for cooling a light bulb and a third air stream passing directly out of the oven cabinet. The air outlets are provided in the front wall of the cabinet to avoid the necessity of providing a separate air ducting system if the oven is mounted in a recessed or built-in manner. An air baffle is used within the cabinet to keep the third air stream separate from the air streams which have passed through the cooking cavity.

13 Claims, 8 Drawing Figures

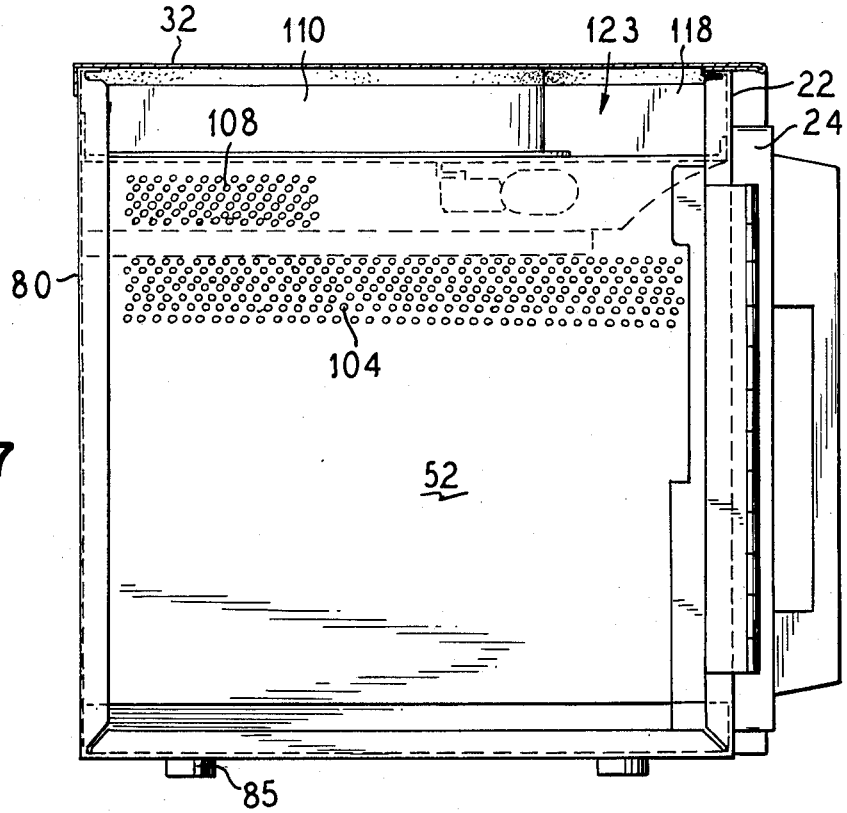
FIG. 7
FIG. 8
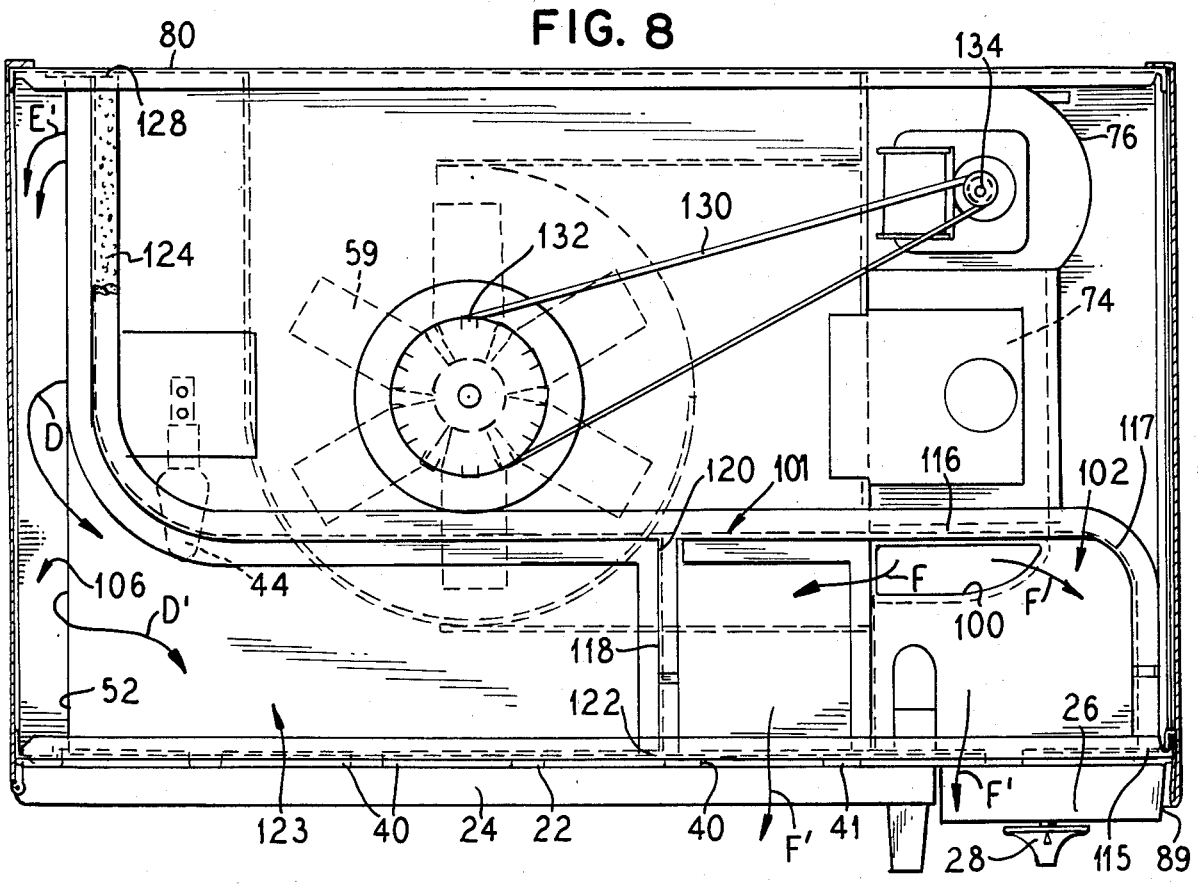

AIR CIRCULATION SYSTEM FOR MICROWAVE OVEN

BACKGROUND OF THE INVENTION

1. Field of the Invention

The present invention relates to microwave ovens and more specifically to the air circulation system for such an oven.

2. Description of the Prior Art

Microwave ovens designed for home and commercial use in heating food items require a carefully designed and constructed cabinet structure enclosing the cooking cavity in order to ensure uniform heating throughout the cavity and to avoid leakage of microwave radiation. Since the operator of such an oven must have easy access to the interior of the cavity, a door with a transparent window is generally provided on the front side of the cavity.

It is known in microwave ovens to provide an air circulation system to provide a cooling for various electrical components such as the power transformer and the magnetron and then to direct the air through the cooking cavity to a discharge region. Air inlets below the power transformer and on the back of the cabinet are known and exhaust outlets at the front of the oven for air that has been circulated through a microwave oven are known, for example, from U.S. Pat. Nos. 2,860,026 and 3,818,171.

The basic idea of splitting an air stream that is being circulated through a microwave oven is disclosed in U.S. Pat. No. 4,123,643 which is assigned to Whirlpool Corporation, the assignee of the present application.

SUMMARY OF THE INVENTION

The present invention provides an air circulation system for a microwave oven that allows the oven to be used in most any type of installation, for example, a built-in, countertop, or suspended installation. Further, the present invention provides an improved air circulation by dividing the air stream to deliver different flow rates to different parts of the oven and to permit increased flow rate over electrical components.

Novel aspects of the air circulation system relate to the use of an additional air inlet adjacent the front control panel to provide a cooling air stream for electrical components secured to the panel, the division of the air stream after it passes through the blower but before it enters the cooking cavity, and the front discharge of the air stream with its associated air baffle member.

The present invention provides for the division of the air flow into three separate streams downstream of the air blower. The first stream enters the oven cavity and exits the cavity in a relatively conventional manner. The second air stream enters the top portion of the cavity and flows over the microwave stirrer and light assemblies to an outlet adjacent the top rear portion of the left side wall. This portion of the cavity is separated from the main cavity portion by a removable panel which is transparent to the microwave radiation. The third air stream does not enter the cavity but goes directly up over the top of the cavity to an air outlet region that is defined by the front cabinet panel. Since the third air stream is delivered to the outlet region at a higher pressure than the air streams which flow through the cavity, an air baffle member is provided to separate this stream from the streams that have passed through the cavity. The baffle prevents the third air stream, which has bypassed the cavity, from creating a region of high pressure along the entire length of the front cabinet air outlets. Such a high pressure region is undesirable because it would reduce the flow of air through the cavity.

By bypassing some of the air directly to the air outlet, the total flow volume over the magnetron and other electric components can be increased to provide improved cooling, without causing excessive air circulation through the cavity itself which is undesirable because it may tend to dry out the foods being cooked or adversely affect the reading of humidity or gas sensors that are sometimes used to monitor the cooking process.

All of the air is exhausted from the oven at the front of the cabinet to avoid the necessity of additional air ducts when mounting the oven in a built-in manner.

DESCRIPTION OF THE DRAWINGS

FIG. 7 is a left side elevational view of the microwave oven with the facing portion of the outer wrapper removed.

FIG. 8 is a top elevational view of the microwave oven with the facing portion of the outer wrapper removed.

DESCRIPTION OF THE PREFERRED EMBODIMENTS

Figure 1:
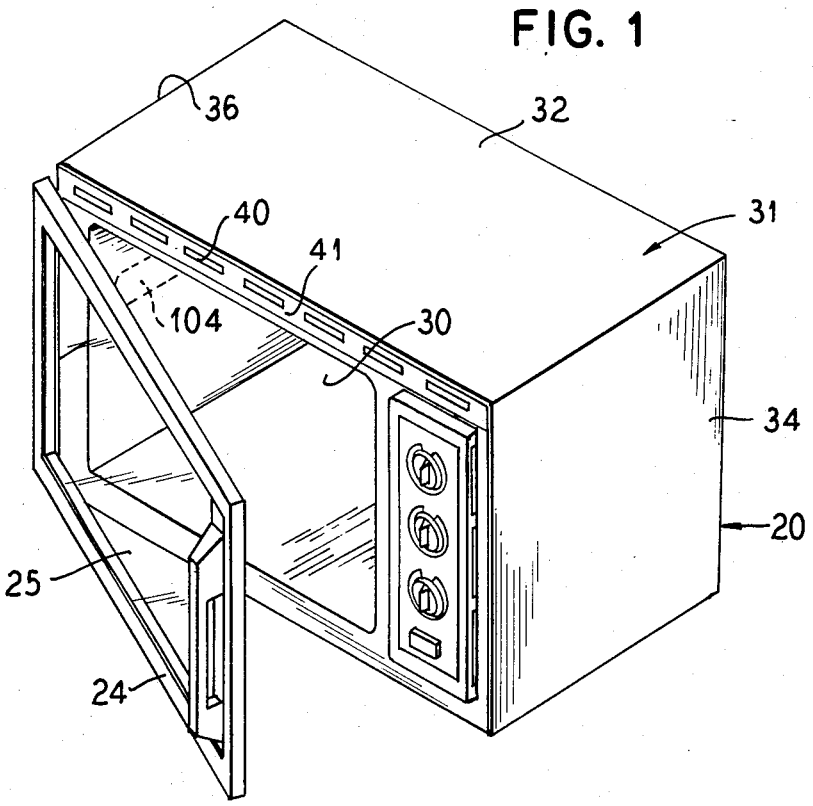
FIG. 1 is a perspective view of a microwave oven embodying the principles of the present invention.

In FIG. 1 there is shown a microwave oven generally at 20 having a front panel 22 with an openable hinged door 24 having a generally transparent central area 25 and a control panel 26 with a plurality of controls 28 for setting the parameters of the heating cycle to be performed by the oven. The hinged door 24 opens to expose a cooking cavity 30.

A removable wrapper 31 forms a finished and aesthetically pleasing appearance for a top outer surface 32 and opposed end wall outer surfaces 34, 36 of the microwave oven cabinet. Located on the front panel 22 above a top edge 38 of the door 24 are a plurality of air vents 40 which provide an exit opening for air which is forced through the interior of the oven 20. A removable exhaust grill 41 covers the air vents 40 resulting in a pleasing appearance of the front panel 22.

Figure 2:
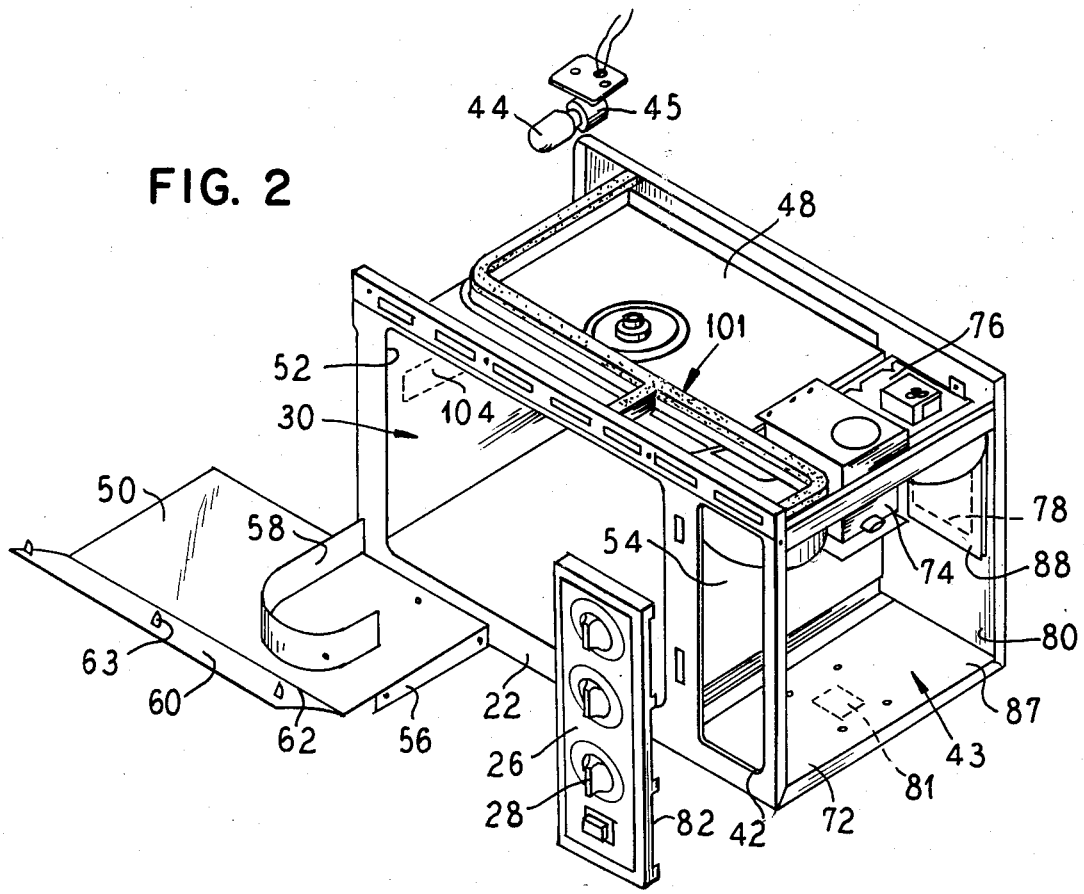
FIG. 2 is a perspective exploded view of the microwave oven of FIG. 1.

In FIG. 2, outer portions of the microwave oven 20 have been removed, such as the wrapper 31, the door 24 and various electrical components. It is seen that the front panel 22 has an opening 42 to provide space for the rear portions of the controls 28 to extend into a chamber 43 which houses substantially all of the electrical components for the microwave oven. Shown in an exploded form are a light bulb 44 and socket connection 45 which normally are located in the interior of the cooking cavity 30 and are attached to a top panel 48 of the cooking cavity.

Also shown in an exploded manner is a protective cover or panel 50 which is placed within the cooking cavity 30 and is made of a translucent plastic material to permit light to shine through the cover 50 to the interior of the cooking cavity 30. The cover 50 attaches to a pair of opposed side panels 52, 54 of the cooking cavity by means of flanges 56 on the edges of the cover so that an upstanding wall 58 on the top side of the cover 50 abuts against the top wall 48 of the cooking cavity 30. The wall 58 surrounds a paddle, or stirrer blade, 59 (FIG. 8) which is used to "stir" the microwave energy within the cooking cavity to enhance the distribution of that energy.

A front panel 60 of the cover 50 is hinged at 62 and is provided with a plurality of locking means 63 such as screws so that it can be selectively opened downwardly to provide access to the light bulb 44 for changing purposes without necessitating the removal of the entire cover 50. Thus, the stirrer blade is continuously protected by the upstanding wall 58 even while the user changes the light bulb 44. The locking screws 63 are received in openings in the top panel 48 of the cooking cavity 30.

Other elements shown in FIG. 2 are a magnetron 74 which produces the microwave energy and a fan or blower 76 which is used for drawing air into the microwave oven cabinet through an opening 78 formed in a rear panel 80 of the oven, an opening 81 formed in a bottom wall portion 72 and a number of openings 82 in the control panel 26 to cool the magnetron 74 and other electrical components within the oven. Also shown is an air baffle 101 mounted on the top wall 48 of the cooking cavity to direct the exiting air streams out through the air vents 40.

Figure 3:
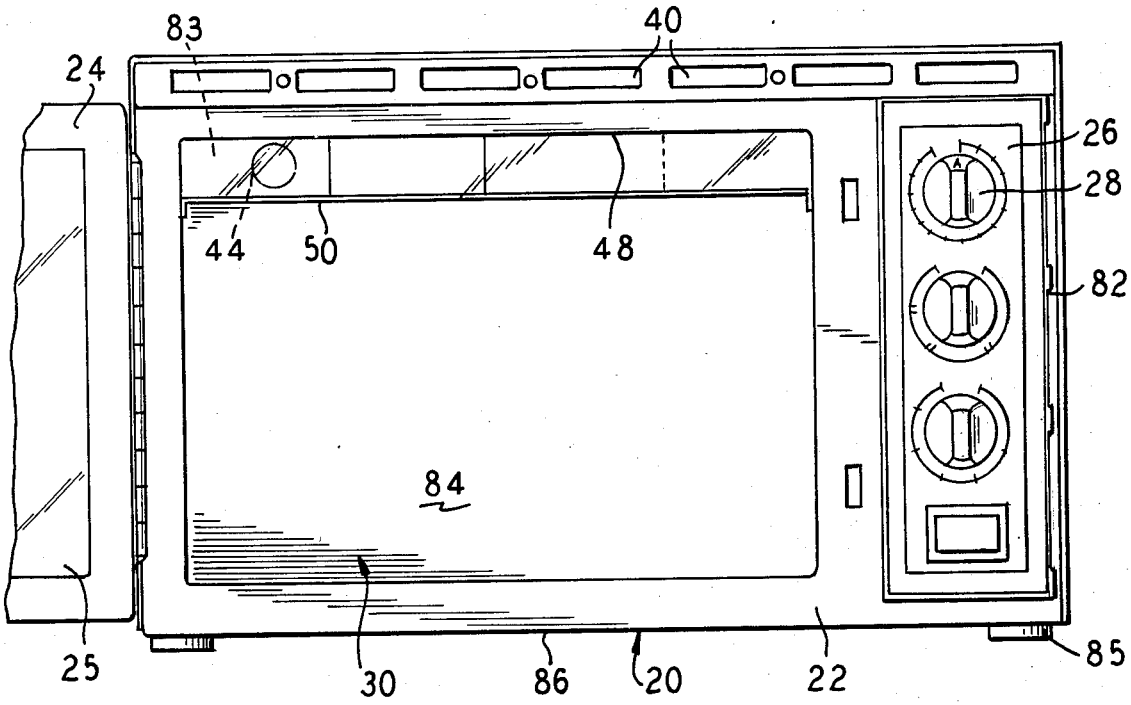
FIG. 3 is a front view of the cavity and cabinet assembly.

FIG. 3 is a front view of the microwave oven showing the location of the cover 50 spaced below a top wall 48 of the cooking cavity to form an upper compartment 83 enclosing the light bulb 44 and a lower compartment 84 where the items to be cooked are placed. The openings 82 along the right side of the control panel 26 are also shown. The microwave oven 20 is mounted on feet 85 to provide a clearance below a bottom wall 86 of the oven to permit air to be drawn into the oven through the inlet opening 81 in a bottom wall portion 72.

Figure 5:
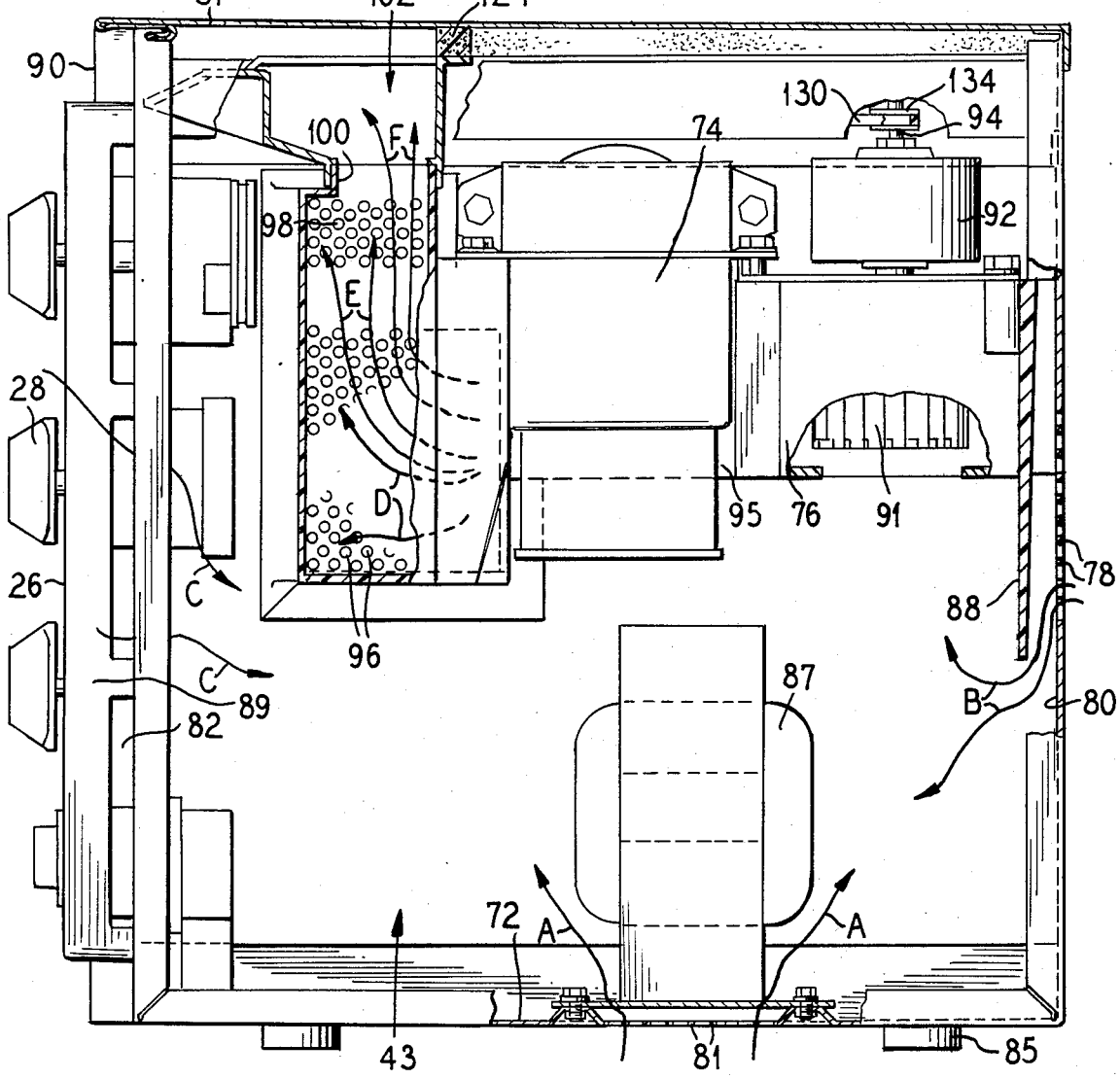
FIG. 5 is a right side view of the microwave oven partially cut away to show interior components.

FIG. 5 is a side end view of the microwave oven looking at the control end of the oven with the outer wrapper 31 partially removed. In this view, it is clearly shown that the bottom air inlet opening 81 comprises a plurality of small openings positioned directly under a power transformer 87 which is bolted directly to the bottom wall portion 72 of the oven. The location of the openings 81 below the transformer provide two distinct functions, a first being to direct the incoming air stream shown by arrows A, over the transformer which is a heat producing electrical component to cool the transformer, and a second function is to prevent the possibility of probing the electrical components in the chamber 43 from outside of the enclosure to prevent shock hazards. This is especially necessary when the oven is mounted in a suspended fashion beneath a cabinet.

The air inlet openings 78 in the rear wall 80 are also shown to be a plurality of small openings and a baffle 88 is shown which extends downwardly to cover the area exposed by the opening 78. The reason for this baffle is also two-fold. A first reason is to direct the incoming air stream, shown by arrows B, downwardly so that it passes over a number of electrical components to cool them before being drawn into the air blower 76. A second reason for the baffle 88 is again to prevent probing through the opening 78 to the electrical components within the chamber 43.

The air inlet openings 82 are provided along only a right side edge 89 of the control panel 26 to provide an inlet air stream, shown by arrows C, to cool electrical components (not shown) mounted on the control panel 26. Although the wrapper 31 is cut away, it is shown at the top of FIG. 5 that a front edge 90 of the wrapper extends farther forward than the openings 82 to prevent direct access through the openings 82, again to prevent a probing of the electrical components from the exterior of the oven.

Thus, air is drawn into the interior of the oven cabinet through three different opening areas to first pass over the electrical components in cavity 43 before being drawn into the air blower 76. The blower 76, which has a squirrel-cage type blower wheel 91, is powered by an electrical motor 92 mounted above the blower housing and has a vertically oriented rotating shaft 94. The air from the blower is directed into a duct housing 95 which surrounds the magnetron 74. The magnetron is the electrical component that generates the microwave energy and is a substantial heat producing element. Thus, the maximum air flow is directed across the magnetron for cooling purposes.

As the air flow leaves the duct housing 95, it is divided into three separate air streams. As seen in FIG. 5, the first air stream, represented by arrows D, is directed through a plurality of openings 96 in a front central portion of the side wall 54 of the cooking cavity. A second air stream, represented by arrows E, is directed through a plurality of openings 98 in an upper front portion of the cooking cavity side wall 54. A third air stream, represented by arrows F, is directed through an opening 100 which leads to a chamber 102 above the top wall 48 of the cooking cavity near the front wall 22 of the oven.

Figure 6:
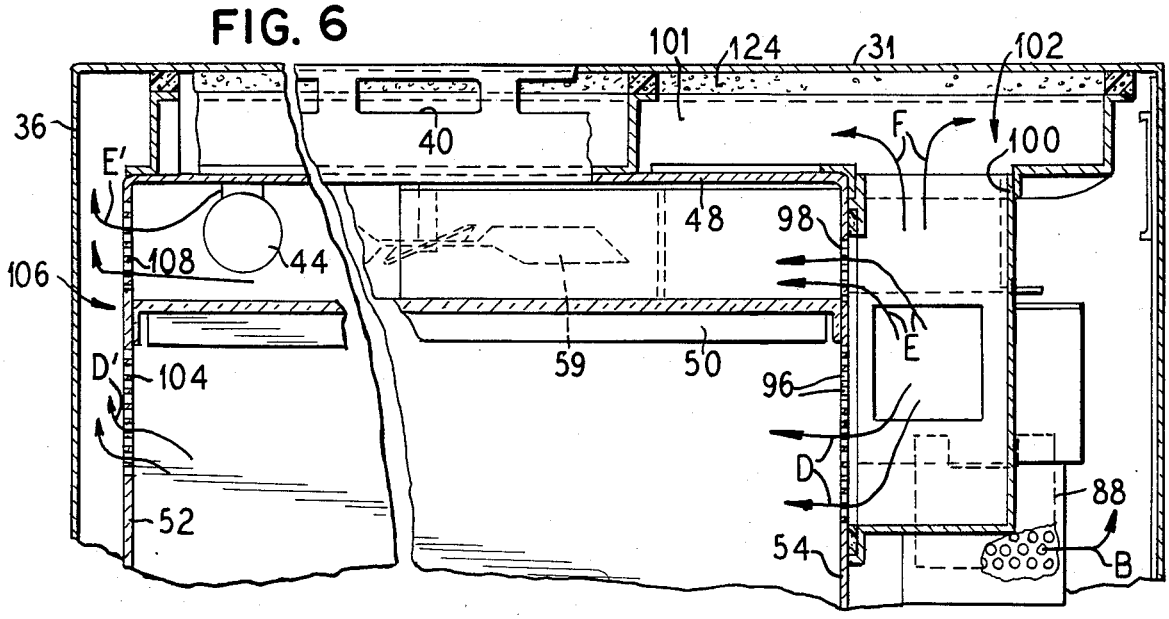
FIG. 6 is a partial front sectional view of the microwave oven.

As seen in FIG. 6, the openings 96 in the side wall 54 are positioned below the protective cover 50 while the openings 98 are positioned above the protective cover 50 but below the top wall 48 of the cooking cavity. A larger open area is provided by openings 96 than openings 98 resulting in air stream D being larger than air stream E. The air stream D directed through the openings 96 passes through the cooking cavity 30, washing across the door 24 to keep the transparent window area 25 free of condensate and exits the cooking cavity 30, as represented by arrows D', through a plurality of openings 104 in the opposite side wall 52 of the cooking cavity to pass into a chamber 106 formed between the cooking cavity wall 52 and the outer wrapper side wall 36. The second air stream E passes through openings 98 and flows across the top of the cooking cavity above the protective cover 50 in the upper chamber to flow across the light bulb 44 for cooling purposes, as represented by arrows E', and then to exit the cooking cavity through openings 108 in a top rear portion of the side wall 52 (FIG. 7) to also flow into chamber 106. Openings 104 provide a larger open area than openings 108 further ensuring that air stream D is larger than air stream E.

The third air stream F, which passes through opening 100 to flow into chamber 102 above the cooking cavity, is caused to pass directly out of the oven cabinet through the openings 40 in the front cabinet wall 22, as represented by arrows F' in FIG. 8. The size of the third air stream F relative to air streams D and E is predetermined by the size of opening 100 and chamber 102.

Figure 4:
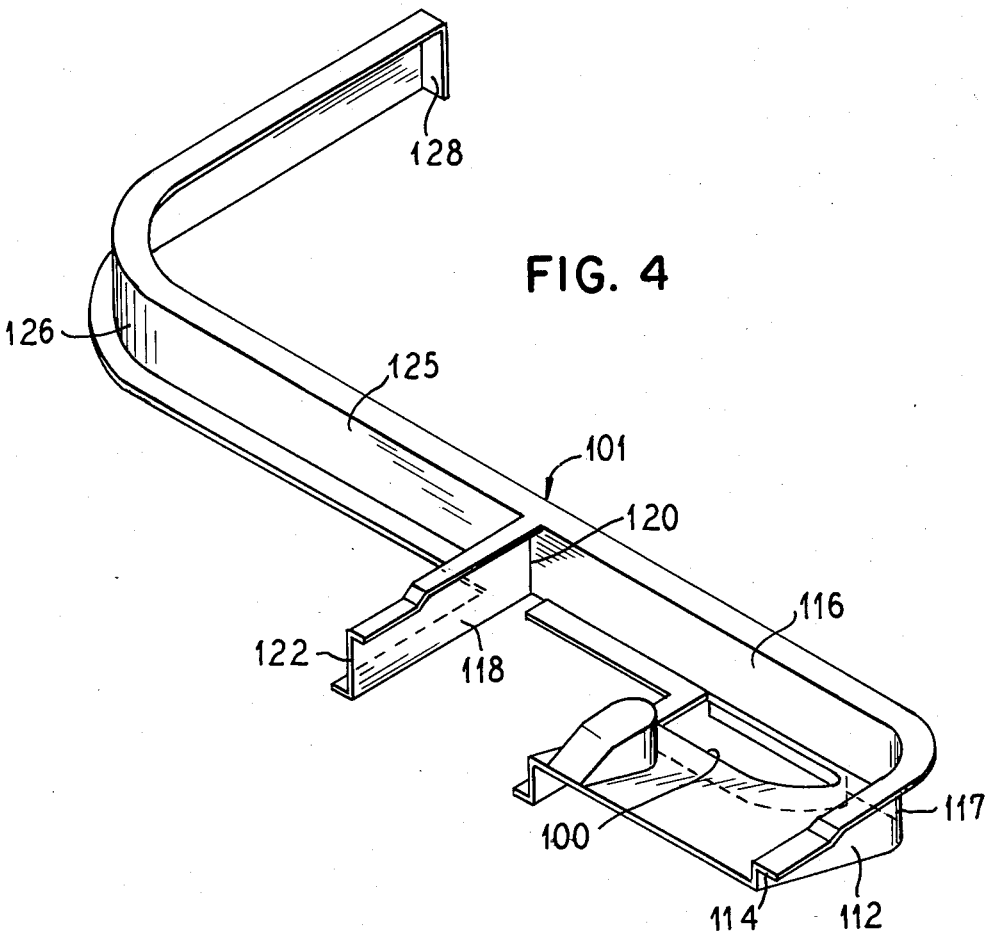
FIG. 4 is a perspective view of the air baffle member.

The chamber 102 is defined by the air baffle 101, shown alone in detail in FIG. 4 and in place in FIG. 8, which has a first segment 112 with a free end 114 engaging the front panel 22 at a top rightmost corner 115 of the oven, a second segment 116 connected by a curved portion 117 to the first segment to proceed in a manner parallel to the front wall 22 of the cabinet away from the right edge of the cabinet, and a segment 118 proceeding perpendicularly from a junction 120 with the second segment 116 towards the front wall 22 and having an end 122 which engages the front wall. Thus, these three segments 112, 116 and 118 form three sides of the chamber 102, the fourth wall being formed by the front wall 22 having the exit openings 40 therethrough.

The air baffle comprises an upstanding wall member with a resilient top portion 124 (FIG. 6) such as foam rubber which can sealingly engage the outer wrapper 31 of the oven cabinet. Thus, the entirety of the third air stream F passing through opening 100 is directed into the chamber 102 and out through the openings 40 in the front panel.

The air from the first and second streams D′, E′ passes out of the cooking cavity through openings 104 and 108 into chamber 106 and flows above the cooking cavity top wall 48 in a chamber 123 to exit through other openings 40 in the front wall 22. The chamber 123 is defined by the air baffle 101 in that a further segment 125 continues parallel to the front wall 22 from the junction 120 along the top of the top cavity wall 48 toward the left side wall 52 of the cooking cavity. As the baffle 101 approaches the left side wall 52, it curves rearwardly at 126 to proceed to the rear of the cooking cabinet parallel to the side wall 52 to terminate in an end 128 which seals against the rear wall 80.

Air streams D, E which pass through the cooking cavity are prevented from commingling with the air stream F which passes directly out of the oven cabinet because of the segment 118 of the air baffle. This separation is necessary in that the air pressure in chamber 102 is higher than the air pressure in chamber 123. Without the wall segment 118 of the air baffle, the back pressure in chamber 123 would be greater, resulting in less of an air flow through the cooking cavity. Also, some microwave constructions employ a humidity or gas sensor in the exhaust air stream to determine when a desired amount of cooking action has been achieved, and if the bypass air stream F were mixed with the oven cavity exhaust air streams, the sensor readings could be adversely affected.

The provision of the wall segment 118 further enhances the air flow out of the openings 40 in the front wall in that air streams continue in a straight line unless directed otherwise by outside influences such as walls. The wall segment 118 acts as a guide to direct the air stream F′ flowing through chamber 102 out the front openings as well as the air streams D′, E′ flowing through chamber 123. Again, the inclusion of this wall segment 118 reduces the back pressure in both of these chambers by directing the air streams toward the front exit openings 40. As seen in FIG. 8, the microwave stirrer 59 is rotated by means of a cable 130 which passes around a pulley 132 mounted on a common shaft with the stirrer 59 and around pulley 134 mounted on shaft 94 of the fan motor 92. Thus, as the fan is rotated, the stirrer is likewise rotated.

It is thus seen that there is provided an air circulation system for a microwave oven in which the air stream which enters the oven cabinet through the front, bottom and rear walls of the cabinet to collectively pass through the blower and across the magnetron, is divided into three separate air streams, a first air stream flowing through a lower compartment of the cooking cavity, a second air stream flowing through a protected compartment of the cooking cavity to cool the light bulb and prevent the buildup of moisture or condensate in the protected compartment, and a third air stream exiting directly from the cabinet without passing through the cooking cavity.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contributions to the art.

The embodiments of the invention in which an exclusive property of privilege is claimed are defined as follows:

1. In a microwave oven having an outer oven cabinet with a front opening door, an inner oven cooking cavity accessed through the door and divided by a panel into a lower cooking area and an upper lighting area with a light bulb, air inlets and outlets in both the oven cabinet and cavity and an air blower in the cabinet to provide an air flow through the inlets and outlets in the cabinet and cavity, means for dividing the air flow from the blower into three spearate air streams comprising:

a first means for directing an air stream through only the cooking cavity lower area and out the front of the oven cabinet;

a second means for directing an air stream through only the cooking cavity upper area, across the light bulb and out the front of the oven cabinet;

said panel forming an air barrier between said cavity lower area and said cavity upper area to prevent the air stream from passing from said cavity upper area to said cavity lower area; and a third means for directing an air stream to bypass the cooking cavity and exit directly out of the front of the oven cabinet;

whereby predetermined proportions of the air flow through the oven cabinet can be directed through each of the individual air streams.

2. A microwave oven according to claim 1 wherein said first means comprises air inlets in a side wall of said cooking cavity lower area and air outlets in an opposite side wall of said cooking cavity lower area for passage of the air stream through the cooking cavity, the air outlets in the cooking cavity communicating with air outlets in the front of the oven cabinet.

3. A microwave oven according to claim 1 wherein said second means comprises air inlets in a side wall of the cooking cavity above the panel and air outlet openings in an opposite side wall of the cooking cavity above the panel, the air outlet openings communicating with openings in the front wall of the cabinet.

4. A microwave oven according to claim 1 wherein said third means comprises a passage within said oven cabinet communicating directly with openings in the front of the oven cabinet.

5. A microwave oven according to claim 1 including an air baffle means to separate the first and second air streams exiting from the cooking cavity from the third air stream exiting directly from the blower.

6. An air circulation system for a microwave oven having an outer oven cabinet and an inner oven cooking cavity comprising:

air inlet means and air outlet means in said cabinet;

a single air blower means for generating an air flow through said cabinet from said inlet means to said outlet means;

air inlet means and air outlet means in said cavity;

a microwave transparent solid barrier dividing said cooking cavity into two separate compartments;

means for splitting said air flow into three separate streams within said cabinet;

a first means directing an air stream through only one of said compartments of said cooking cavity and then to said outlet means of said cavity and said cabinet;

a second means for directing an air stream through only a second of said compartments in said cooking cavity and then to said outlet means of said cavity and cabinet;

said solid barrier forming an air barrier between said two separate compartments to prevent the air streams in said two separate compartments from mixing within said cavity; and a third means for directing an air stream directly out of said cabinet without passing through said cooking cavity.

7. An air circulation system according to claim 6 wherein said air inlet means in said cabinet comprise openings in a front wall, a bottom wall and a rear wall of said cabinet.

8. An air circulation system according to claim 7 wherein said microwave oven has an electrical component compartment and said air inlet openings in said cabinet communicate with said component compartment, whereby electrical components are cooled by said air flow through said cabinet.

9. An air circulation system according to claim 7 wherein said microwave oven has a control panel on a front wall thereof and said air inlet openings in said front wall are closely associated with said control panel, whereby controls on said control panel are cooled by air flowing through said inlet openings.

10. An air circulation system according to claim 6 wherein said air outlet means in said oven cabinet comprise openings located only on a front wall of said cabinet.

11. An air circulation system according to claim 6 wherein air baffle means are provided to separate the air streams which pass through the cooking cavity from the air stream which does not pass through the cooking cavity.

12. An air circulation system for a microwave oven having an outer oven cabinet and an inner oven cooking cavity comprising:

air inlet means in said cabinet comprising openings in a rear wall, a bottom wall and a control panel mounted on a front wall to direct incoming air across electrical components mounted on the interior of said cabinet;

air outlet means comprising openings formed only on said front wall of said cabinet;

a single air blower means mounted within said cabinet for generating an air flow through said cabinet;

a microwave transparent solid barrier dividing said cooking cavity into an upper compartment and a lower compartment;

an outer cabinet wrapper enclosing a space within the oven cabinet and exterior of the cooking cavity;

means for splitting the air flow downstream of said blower means into three separate streams within said cabinet;

a first means comprising inlet openings in said cooking cavity in a first of said compartments and outlet openings in an opposite wall of the cooking cavity to permit a first of said air streams to exit into said space between said cooking cavity and said wrapper;

a second means comprising inlet openings in said cooking cavity in a second of said compartments and outlet openings in an opposite wall of said cooking cavity to permit a second of said air streams to exit into said space between said cooking cavity and said wrapper;

said solid barrier preventing said first and second air streans from mixing within said cavity;

a third means comprising a passage communicating directly with said air outlet openings in said cabinet front wall; and an air baffle means preventing said third air stream from mixing with said first and second air streams prior to exiting the cabinet.

13. An air circulation system according to claim 12 wherein said air baffle means is positioned in said space between said cooking cavity and said cabinet wrapper.

* * * * *